US006768400B2

(12) United States Patent
Tanabe

(10) Patent No.: US 6,768,400 B2
(45) Date of Patent: Jul. 27, 2004

(54) MICROSTRIP LINE HAVING A LINEAR CONDUCTOR LAYER WITH WIDER AND NARROWER PORTIONS

(75) Inventor: Mitsuru Tanabe, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 18 days.

(21) Appl. No.: 09/838,214

(22) Filed: Apr. 20, 2001

(65) Prior Publication Data

US 2001/0033210 A1 Oct. 25, 2001

(30) Foreign Application Priority Data

Apr. 20, 2000 (JP) ..... 2000-119604

(51) Int. Cl.[7] ..... H01P 3/08
(52) U.S. Cl. ..... 333/238; 333/246
(58) Field of Search ..... 333/238, 246

(56) References Cited

U.S. PATENT DOCUMENTS 4,973,925 A 11/1990 Nusair et al.
5,493,263 A * 2/1996 Tozawa ..... 333/238
6,016,087 A * 1/2000 Sasaki et al. ..... 333/238 X

FOREIGN PATENT DOCUMENTS

| | | | | |
|---|---|---|---|---|
| JP | 158801 | * | 6/1989 | ..... 333/238 |
| JP | 40537207 | * | 2/1993 | ..... 333/238 |
| JP | 405299905 | * | 11/1993 | ..... 333/238 |
| JP | 08-116028 | | 5/1996 | |
| JP | 09-148525 | | 6/1997 | |

* cited by examiner

*Primary Examiner*—Benny T. Lee
(74) *Attorney, Agent, or Firm*—Nixon Peabody, LLP

(57) ABSTRACT

A microstrip line includes a ground conductor layer, a dielectric layer formed on the ground conductor layer, and a linear conductor layer formed on the dielectric layer to have a linear configuration. The linear conductor layer has a wider portion in the upper part of a cross section thereof taken in a direction perpendicular to the direction in which the linear conductor layer extends and a narrower portion in the lower part of the cross section. The narrower portion is smaller in width than the wider portion.

2 Claims, 16 Drawing Sheets

MICROSTRIP LINE HAVING A LINEAR CONDUCTOR LAYER WITH WIDER AND NARROWER PORTIONS

BACKGROUND OF THE INVENTION

The present invention relates to a microstrip line, to a method for fabricating the same, to an inductor element, and to an RF semiconductor device.

As the number of users of radio communication systems including mobile phones has increased year by year, size and cost reduction has been required increasingly of mobile terminal equipment used in the radio communication systems. An RF device which is a primary component of the mobile terminal equipment has been reduced in cost by forming it into a so-called MMIC (Monolithic Microwave IC) in which an active element and a passive element are formed integrally in a substrate, instead of forming it into a multichip IC in which the active and elements are integrated separately in the substrate as has been practiced conventionally.

FIG. 15 shows a conventional RF circuit. FIG. 16 shows a plan configuration of an RF semiconductor device in which the RF circuit shown in FIG. 15 is implemented in a substrate. In FIG. 16, the same components as shown in FIG. 15 are designated by the same reference numerals. Specifically, the RF circuit comprises a DC blocking capacitance 307, a register 308, a drain terminal 313, a gate terminal 314 and a source terminal 315.

As can be seen from FIGS. 15 and 16, each of passive elements including spiral inductors 302 and 303 disposed between an input terminal 311 and an amplifying FET 301, spiral inductors 304 and 305 disposed between the drain of the FET 301 and an output terminal 312, and a dc blocking capacitance 306 occupies an area larger than occupied by the amplifying FET 301 which is an active element.

To further reduce the RF semiconductor device in cost, it is necessary to reduce the passive elements in size and thereby increase chip yield per slice (wafer). Chip area has been reduced conventionally by using a strontium titanium oxide (STO), which is a high dielectric material, as a dielectric material composing a dc blocking capacitance or by-pass capacitance and thereby reducing the area of the capacitance (GaAs IC symposium 1998).

On the other hand, Japanese Unexamined Patent Publications Nos. HEI 8-116028 and HEI 9-148525 disclose technology for reducing the size of an inductor element by using STO as a dielectric material composing a microstrip line and thereby reducing the wavelength of a signal electromagnetic wave.

However, the conventional microstrip line has the problem of degrading the characteristics of the MMIC since, if the width of the line is reduced such that the characteristic impedance of the line or the inductance of the inductor is increased, the cross-sectional area of the line is reduced and a conductor loss is increased accordingly.

To increase the impedance of the microstrip line disclosed in Japanese Unexamined Patent Publication No. HEI 8-116028 or HEI 9-148525, in particular, it is necessary to reduce the width of the line to 0.5 $\mu$m or less since a high dielectric material is used as the dielectric material composing the microstrip line, which presents an obstacle to the practical use thereof. This is because a dielectric thin film formed by sputtering or physical or chemical vapor deposition such as CVD is difficult to increase in thickness. In order to increase the impedance of a microstrip line, in general, it is necessary to reduce the width of the linear conductor portion, which increases a conductor loss in the linear conductor portion.

SUMMARY OF THE INVENTION

It is therefore an object of the present invention to prevent an increase in conductor loss even if the width of a microstrip line is reduced such that the impedance of the microstrip line or the inductance of an inductor element is increased and thereby solve the foregoing problem encountered by the prior art.

To attain the object, a microstrip line according to the present invention comprises: a ground conductor layer; a dielectric layer formed on the ground conductor layer; and a linear conductor layer formed on the dielectric layer to have a linear configuration, the linear conductor layer having a wider portion in an upper part of a cross section thereof taken in a direction perpendicular to a direction in which the linear conductor layer extends and a narrower portion in a lower part of the cross section, the narrower portion being smaller in width than the wider portion.

In the microstrip line of the present invention, an increase in conductor loss is prevented since the impedance and inductance can be increased in the part thereof closer to the dielectric layer and, in addition, the upper part thereof at a distance from the dielectric layer is larger in width than the narrower portion. This allows a reduction in the size of an RC semiconductor device without degrading the operation characteristics thereof.

Preferably, the microstrip line of the present invention further comprises a substrate for holding the ground conductor layer, the substrate being located under the ground conductor layer and composed of a dielectric material, wherein the dielectric layer has a dielectric constant higher than a dielectric constant of the substrate. In the arrangement, the wavelength of an RF signal propagating through the linear conductor is reduced so that an RF circuit is surely reduced in size.

In the microstrip line of the present invention, the dielectric layer preferably contains a titanium oxide.

In this case, the titanium oxide is preferably a strontium titanate.

A method for fabricating a microstrip line according to the present invention comprises the steps of: forming a ground conductor layer on a substrate composed of a dielectric material; forming a dielectric layer on the ground conductor layer; forming a mask pattern having a linear opening on the dielectric layer; depositing a layer forming a linear conductor layer on the mask pattern including the opening; and patterning the linear-conductor-layer forming layer such that the linear-conductor-layer forming layer on the mask pattern has a width larger than a width of the opening.

The method for fabricating a microstrip line of the present invention forms the linear-conductor-layer forming layer such that the width of the linear-conductor-layer forming layer is larger than the width of the opening, thereby forming the linear conductor layer having the wider portion in the upper part of the cross section and the narrower portion narrower than the wider portion in the lower part of the cross section. This ensures the formation of the wider portion and the narrower portion of the linear conductor layer of the microstrip line according to the present invention.

An inductor element according to the present invention comprises a microstrip line composed of a ground conductor layer, a dielectric layer formed on the ground conductor layer, and a linear conductor layer formed on the dielectric layer to have a linear configuration, the linear conductor layer being formed in a spiral configuration in a plane parallel to the dielectric layer and having a wider portion in an upper part of a cross section thereof taken in a direction perpendicular to a direction in which the linear conductor layer extends and a narrower portion in a lower part of the cross section, the narrower portion being smaller in width than the wider portion.

An RF semiconductor device according to the present invention comprises: an active element formed in a substrate; and a microstrip line formed on the substrate to propagate input/output signals to and from the active element, the microstrip line being composed of a ground conductor layer formed on the substrate, a dielectric layer formed on the ground conductor layer, and a linear conductor layer formed on the dielectric layer to have a linear configuration, the linear conductor layer having a wider portion in an upper part of a cross section thereof taken in a direction perpendicular to a direction in which the linear conductor layer extends and a narrower portion in a lower part of the cross section, the narrower portion being smaller in width than the wider portion.

In the RF semiconductor device of the present invention, the wavelength of an RF signal propagating through the linear conductor becomes shorter when a high dielectric material is used in the dielectric layer thereof. This ensures a reduction in the size of the RF semiconductor device.

DETAILED DESCRIPTION OF THE INVENTION

Embodiment 1

A first embodiment of the present invention will be described with reference to the drawings.

Figure 1:
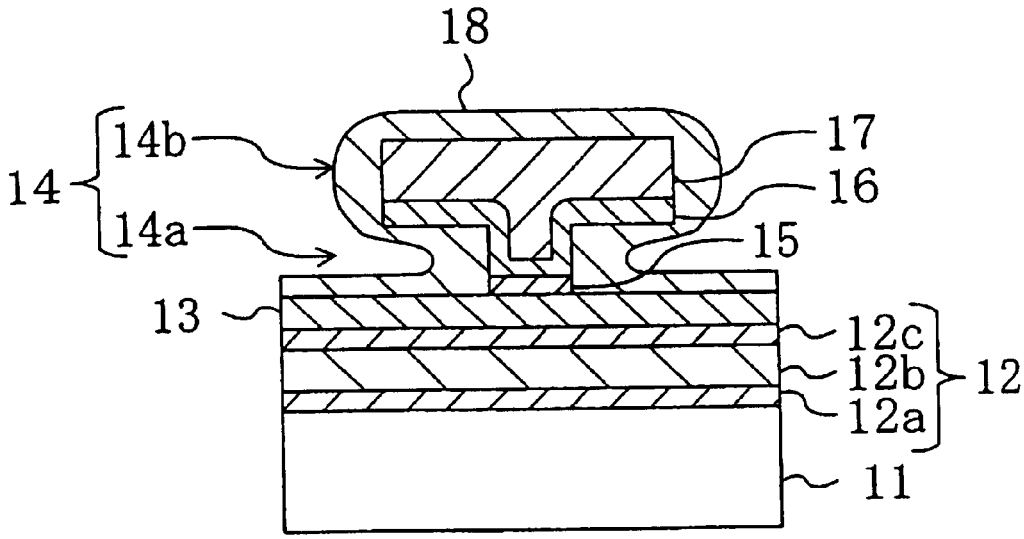
FIG. 1 is a structural cross-sectional view showing a microstrip line according to a first embodiment of the present invention.

FIG. 1 shows a cross-sectional structure of a microstrip line according to the first embodiment. As shown in FIG. 1, a microstrip line composed of a ground electrode 12 as a ground conductor layer, a dielectric layer 13 composed of a strontium titanate oxide ($SrTiO_3$) with a thickness of about 0.5 $\mu$m, and a linear conductor layer 14 is formed on a semi-insulating substrate 11 composed of GaAs.

The ground electrode 12 consists of: a first layer 12*a* composed of a multilayer structure of titanium (Ti) with a thickness of about 0.05 $\mu$m and gold (Au) with a thickness of about 0.5 $\mu$m; a second layer 12*b* composed of Au with a thickness of about 2.5 $\mu$m; and a third layer 12*c* composed of a multilayer structure of platinum (Pt) with a thickness of about 0.2 $\mu$m and Ti with a thickness of about 0.02 $\mu$m, which are stacked in this order on the substrate 11.

The linear conductor layer 14 is composed of a wider portion 14*b* with a width of about 5 $\mu$m and a narrower portion 14*a* with a width of about 0.5 $\mu$m which extends downwardly of the wider portion 14*b*. The linear conductor layer 14 is a multilevel structure composed of a plurality of materials, which consists of: a first layer 15 composed of a tungsten silicon nitride (WSiN) with a thickness of about 0.1 $\mu$m; a second layer 16 composed of a multilayer structure of Ti with a thickness of about 0.05 $\mu$m and Au with a thickness of about 0.5 $\mu$m; and a third layer 17 composed of Au with a thickness of about 3 $\mu$m.

The upper surface of the dielectric layer 13 and the side and upper surfaces of the linear conductor layer 14 are covered with a protective insulating layer (a passivation film) 18 composed of silicon dioxide ($SiO_2$) with a thickness of about 0.5 $\mu$m.

Referring to the drawings, a description will be given to a method for fabricating the microstrip line thus constituted.

FIGS. 2A to 2C and FIGS. 3A and 3B show the cross-sectional structures of the microstrip line according to the first embodiment in the individual process steps of the fabrication method therefor.

Figure 2A:
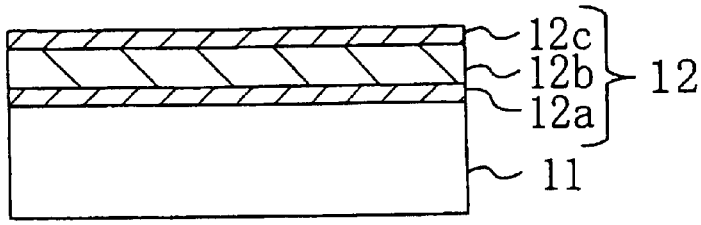
FIGS. 2A, 2B and 2C are structural cross-sectional views illustrating the individual process steps of a method for fabricating the microstrip line according to the first embodiment.

First, as shown in FIG. 2A, the first layer 12*a* composed of the Ti/Au multilayer structure, the second layer 12*b* composed of Au, and the third layer 12*c* composed of the Pt/Ti multilayer structure are formed on the substrate 11 by vapor deposition, whereby the ground electrode 12 composed of the first, second, and third layers 12*a*, 12*b*, and 12*c* is formed.

Figure 2B:
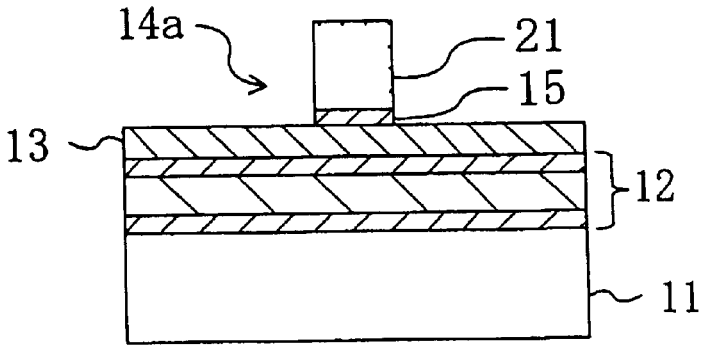

Next, as shown in FIG. 2B, the dielectric layer 13 composed of a STO is deposited over the entire surface of the ground electrode 12 by RF sputtering for which the substrate temperature is adjusted to about 300° C. Subsequently, the first layer 15 of the linear conductor layer composed of WSiN is deposited by RF sputtering. Then, a first resist film 21 having a line pattern with a width of about 0.5 $\mu$m is formed and the first layer 15 is etched back to be patterned by using carbon tetrafluoride ($CF_4$) and using the first resist film 21 as a mask, thereby forming the narrower portion 14*a*. Subsequently, sintering (heat treatment) is performed in an oxygen ambient at a temperature of about 450° C., which recrystallizes the dielectric layer 13 and provides uniform crystal orientation as well as a high dielectric constant.

Figure 2C:
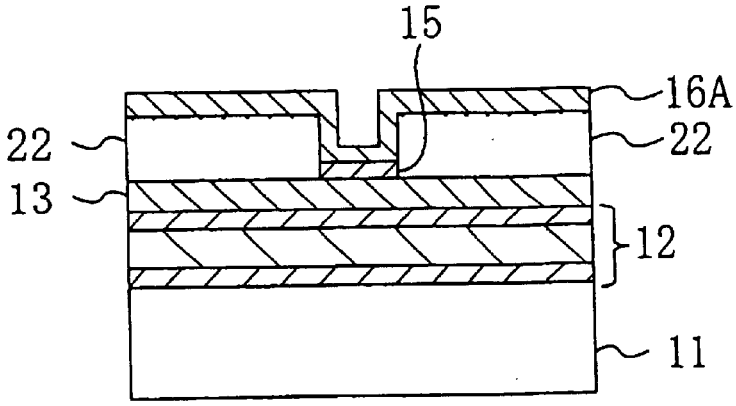

Next, as shown in FIG. 2*c*, a positive second resist film 22 is coated on the entire surface of the substrate 11 and formed by lithography into an opening pattern for exposing the first layer 15. Then, a layer 16A forming the second layer of the linear conductor layer composed of the Ti/Au multilayer structure is deposited by vapor deposition over the entire surface of the second resist film 22 including the wall and bottom surfaces of the opening pattern.

For the sake of brevity and clarity, similar elements or features in different drawing figures that are referred to by same reference labels may not be repeatedly described for all drawing figures in which they appear.

Figure 3A:
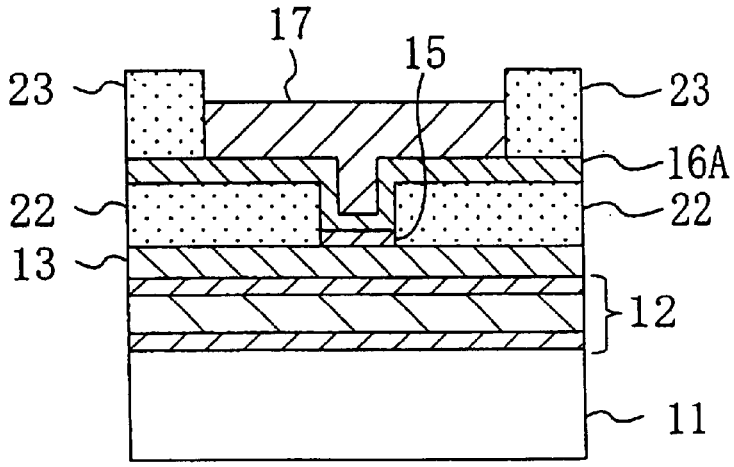
FIGS. 3A and 3B are structural cross-sectional views illustrating the individual process steps of the method for fabricating the microstrip line according to the first embodiment.
Figure 3B:
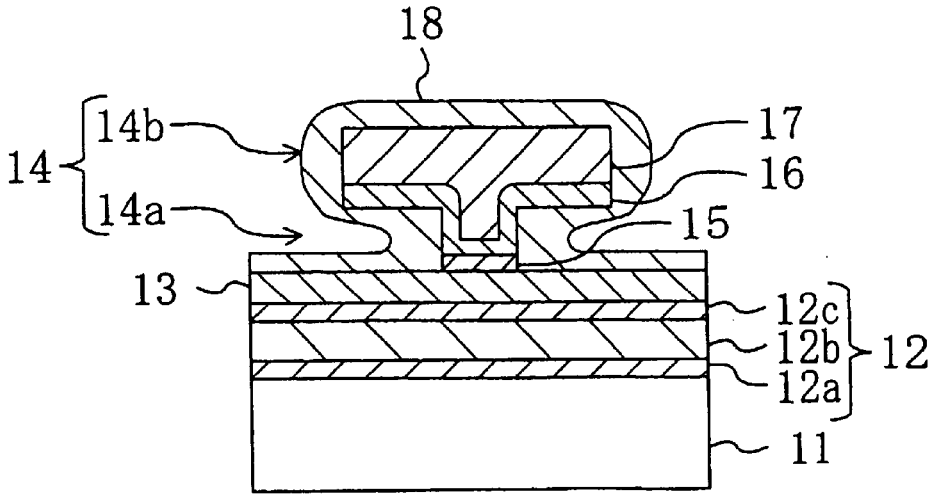

Next, as shown in FIG. 3B, the third resist film 23 shown in FIG. 3A is removed and an unwanted portion of the Au layer in the upper part of the multilayer structure composing the second-layer forming layer 16A shown in FIG. 3A is removed by using an etchant composed of potassium iodine (KI). Subsequently, an unwanted portion of the Ti layer in the lower part of the multilayer structure composing the second-layer forming layer 16A is removed by using hydrogen fluoride (HF), whereby the second-layer forming layer 16A is patterned into the second layer 16 of the linear conductor layer 14. Thereafter, the second resist film 22 shown in FIG. 3A is removed by using a resist remover and then the protective insulating film 18 composed of a silicon dioxide is deposited entirely over the dielectric layer 13 so as to cover the linear conductor layer 14.

Next, as shown in FIG. 3B, the third resist film 23 is removed and an unwanted portion of the Au layer in the upper part of the multilayer structure composing the second-layer forming layer 16A is removed by using an etchant composed of potassium iodine (KI). Subsequently, an unwanted portion of the Ti layer in the lower part of the multilayer structure composing the second-layer forming layer 16A is removed by using hydrogen fluoride (HF), whereby the second-layer forming layer 16A is patterned into the second layer 16 of the linear conductor layer 14. Thereafter, the second resist film 22 is removed by using a resist remover and then the protective insulating film 18 composed of a silicon dioxide is deposited entirely over the dielectric layer 13 so as to cover the linear conductor layer 14.

By the foregoing fabrication steps, there is obtained the microstrip line in a T-shaped cross-sectional configuration having the upper part composed of the wider portion 14*b* and the lower part composed of the narrower portion 14*a* which is narrower than the wider portion 14*b*.

Instead of the second resist film 22, a mask pattern composed of a silicon nitride may also be used. In this case, the etchant is composed of, e.g., a hot phosphoric acid.

Thus, if STO is used in the dielectric layer 13 formed between the linear conductor layer 14 and the ground electrode 12 in the microstrip line, the dielectric constant of STO is as high as 200 so that the wavelength of an electromagnetic wave propagating along the microstrip line becomes about a quarter of that of an electromagnetic wave propagating along a microstrip line using GaAs as a dielectric material. This indicates that, if STO is used in the dielectric layer 13, the quarter wavelength ($\lambda/4$) of an electromagnetic wave which is 6 mm at a frequency of 5 GHz when GaAs is used in the dielectric layer 13 is reduced to the order of 1.5 mm. The wavelength reducing effect allows the adoption of a distributed constant circuit at 5 GHz, which has been impossible due to a chip size limit, thereby achieving a significant reduction in chip size.

Under the present circumstances, however, the formation of a STO film with a thickness of 0.5 $\mu$m requires two hours so that the formation of a thicker STO film is not appropriate because it further reduces throughput. To implement a microstrip line with higher impedance, therefore, a reduction in the width of the conductive material is essential. However, a mere reduction in width incurs a higher loss in the microstrip line.

The first embodiment forms the part of the linear conductor layer 14 which adjoins the dielectric layer 13 into the narrower portion 14*a* and defines the impedance of the line by the narrower portion 14*a*, while forming the part of the linear conductor layer 14 at a distance from the dielectric layer 13 into the wider portion 14*b* and thereby restricting a conductor loss. This provides a high-impedance and low-loss line.

Although the protective insulating film 18 composed of the silicon dioxide has been filled in the space between the wider portion 14*b* of the linear conductor layer 14 and the dielectric layer 13 in order to protect the strip line, it is preferred not to fill the protective insulating film 18 in terms of operation characteristics. In the case of filling the protective insulating film 18, therefore, a low dielectric film having a relatively low dielectric constant such as an organic material composed of, e.g., benzocyclobutene, DUROID, or a polymide film is use preferably.

Preferably, a larger distance is provided between the dielectric layer 13 and the wider portion 14*b*. The arrangement suppresses the coupling capacitance between the wider portion 14*b* and the ground electrode 12. If the coupling capacitance is increased, the wider portion 14*b* greatly affects the impedance of the strip line and prevents the strip line from having higher impedance.

The microstrip line according to the first embodiment may be used appropriately to form an inductor element such as a spiral inductor element. The arrangement increases a relative coefficient determined by the ratio of the width of the linear conductor layer 14 to the distance between the linear conductor layer 14 and the ground electrode 12 so that the inductance value of the spiral inductor element is increased.

Because the relative coefficient is also applied to an inductor element having a configuration other than a spiral, the microstrip line according to the present embodiment is also effective not only in the spiral inductor element but also in inductor elements having other configurations such as a meander and a loop.

Although the first embodiment has used Au as the primary material of the linear conductor layer 14 and the ground electrode 12, the use of a material having a conductivity higher than that of Au, such as Ag or Cu, further reduces the conductor loss. Alternatively, a superconducting material may also be used as the primary material of the linear conductor layer 14 and the ground electrode 12.

Although the first embodiment has configured the microstrip line as a thin-film microstrip line (TFMS) using STO in the dielectric layer 13 thereof, a thin film composed of an organic material or another dielectric material may also be used in the dielectric layer 13 of the thin-film microstrip line.

Although the first embodiment has used GaAs in the substrate 11, an inorganic material composed of a glass material such as Si or quartz or of alumina or an organic material composed of polystyrene or Teflon may also be used instead.

It is also possible to use the linear conductor layer 14 having the cross section according to the present embodiment as a signal line of a coplanar line.

Embodiment 2

A second embodiment of the present invention will be described with reference to the drawings.

Figure 4:
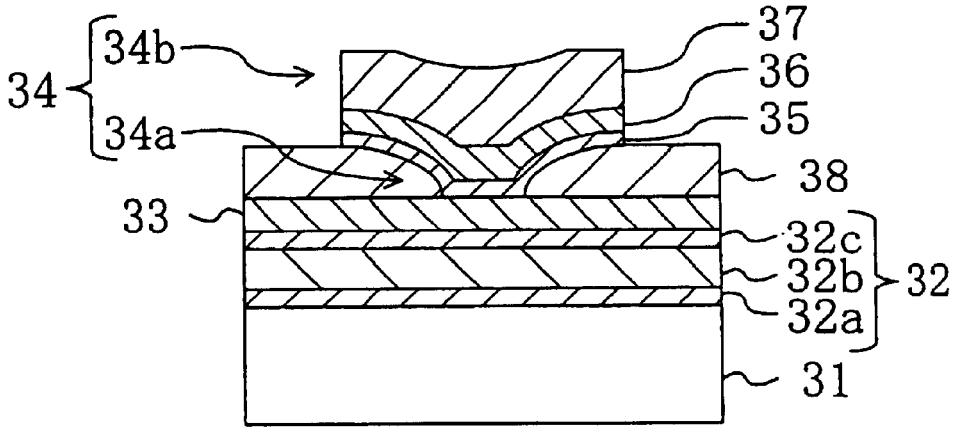
FIG. 4 is a structural cross-sectional view of a microstrip line according to a second embodiment of the present invention.

FIG. 4 shows a cross-sectional structure of a microstrip line according to the second embodiment. As shown in FIG. 4, a ground electrode 32 as a ground conductor layer, a dielectric layer 33 composed of a strontium titanate (STO) with a thickness of about 0.5 μm, and a microstrip line composed of a linear conductor layer 34 are formed on a semi-insulating substrate 31 composed of GaAs.

The ground electrode 32 consists of: a first layer 32*a* composed of a multilayer structure of Ti with a thickness of about 0.05 μm and Au with a thickness of about 0.5 μm; a second layer 32*b* composed of Au with a thickness of about 2.5 μm; and a third layer 32*c* composed of a multilayer structure of Pt with a thickness of about 0.2 μm and Ti with a thickness of about 0.02 μm, which are stacked in this order on the substrate 31.

The linear conductor layer 34 is composed of a narrower portion 34*a* with a width of about 0.5 μm and a wider portion 34*b* with a width of about 5 μm. The linear conductor layer 34 is a multilevel structure composed of a plurality of materials, which consists of a first layer 35 composed of WSiN with a thickness of about 0.1 μm, a second layer 36 composed of a multilayer of Ti with a thickness of about 0.05 μm and Au with a thickness of about 0.5 μm, and a third layer 37 composed of Au with a thickness of about 3 μm.

A support insulating film 38 composed of a low dielectric material such as silicon dioxide ($SiO_2$) with a thickness of about 1 μm is filled in the space between the upper surface of the dielectric layer 33 and the narrower portion 34*a* of the linear conductor layer 34.

Referring to FIGS. 5A–5C, 6A and 6B, a description will be given to a method for fabricating the microstrip line thus constituted.

FIGS. 5A to 5C and FIGS. 6A and 6B show the cross-sectional structures of the microstrip line according to the second embodiment in the individual process steps of the fabrication method therefor.

Figure 5A:
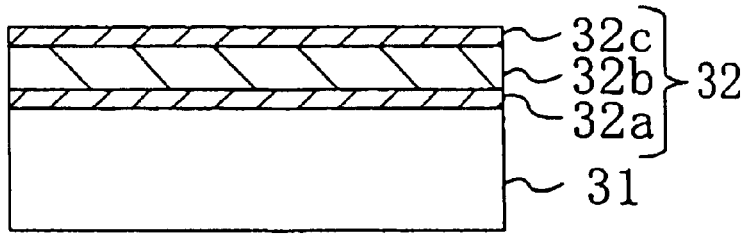
FIGS. 5A, 5B and 5C are structural cross-sectional views illustrating the individual process steps of a method for fabricating the microstrip line according to the second embodiment.

First, as shown in FIG. 5A, the first layer 32*a* composed of the Ti/Au multilayer, the second layer 32*b* composed of Au, and the third layer 32*c* composed of the Pt/Ti multilayer structure are deposited successively on the substrate 31 by vapor deposition, whereby the ground electrode 32 composed of the first, second, and third layers 32*a*, 32*b*, and 32*c* is formed on the substrate 31.

Figure 5B:
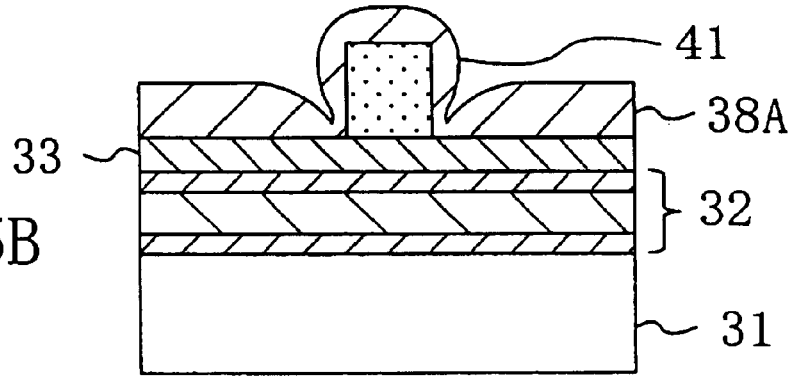

Next, as shown in FIG. 5B, the dielectric layer 33 composed of STO is deposited over the entire surface of the ground electrode 32 by RF sputtering for which the substrate temperature is adjusted to about 300° C. Then, a first resist film 41 having a line pattern with a width of about 0.5 μm is formed on the region of the deposited dielectric layer 33 on which the narrower portion of the linear conductor layer is to be formed. Subsequently, a support-insulating-film forming film 38A composed of $SiO_2$ is deposited entirely over the dielectric layer 33 including the first resist film 41 by, e.g., ion beam sputtering.

Figure 5C:
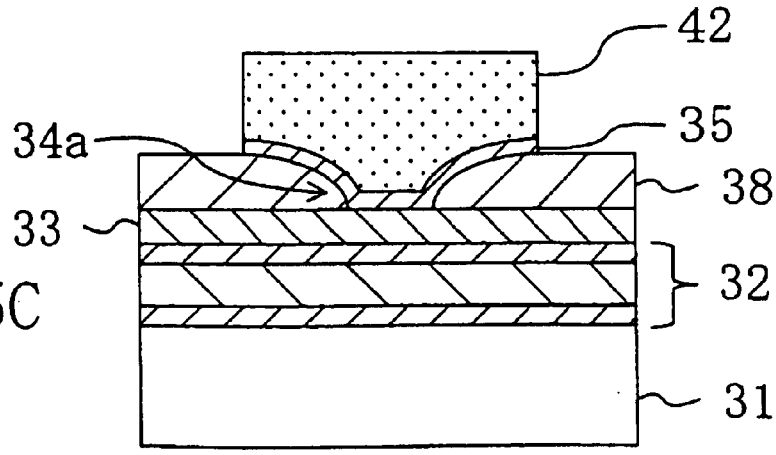

Next, as shown in FIG. 5C, the narrower-portion formation region of the dielectric layer 33 is exposed by lifting off the first resist film 41 shown in FIG. 5B. Then, the first layer 35 of the linear conductor layer composed of WSiN is deposited by RF sputtering. Thereafter, a second resist film 42 is coated on the deposited first layer 35 and formed into a line pattern with a width of about 5 μm by lithography so as to include the narrower-portion formation region. Subsequently, the first layer 35 is etched back by using the formed second resist film 42 as a mask and using $CF_4$ to be formed into a pattern including the narrower portion 34*a*. Thereafter, sintering is performed in an oxygen ambient at a temperature of about 450° C. to recrystallize the dielectric layer 33 and thereby increase the dielectric constant of the dielectric layer 33.

Figure 6A:
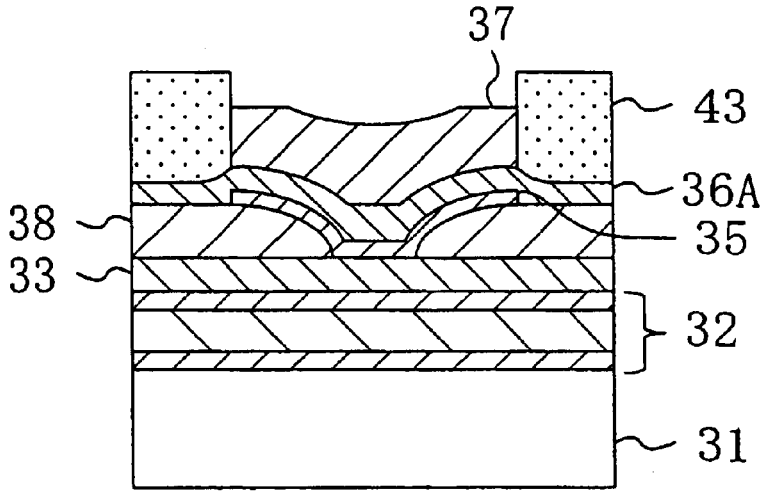
FIGS. 6A and 6B are structural cross-sectional views illustrating the individual process steps of the method for fabricating the microstrip line according to the second embodiment.

Next, as shown in FIG. 6A, a layer 36A forming the second layer of the linear conductor layer is formed entirely over the support insulating film 38 and the first layer 35 by vapor deposition. Thereafter, a third resist film 43 is coated on the second layer forming layer 36A and formed by lithography into an opening pattern having a width of about 5 μm and including the first layer 35 of the linear conductor layer. Subsequently, the third layer 37 of the linear conductor layer composed of Au is formed by plating on the layer 36A forming the second layer of the linear conductor layer by using the third resist film 43 as a mask.

Figure 6B:
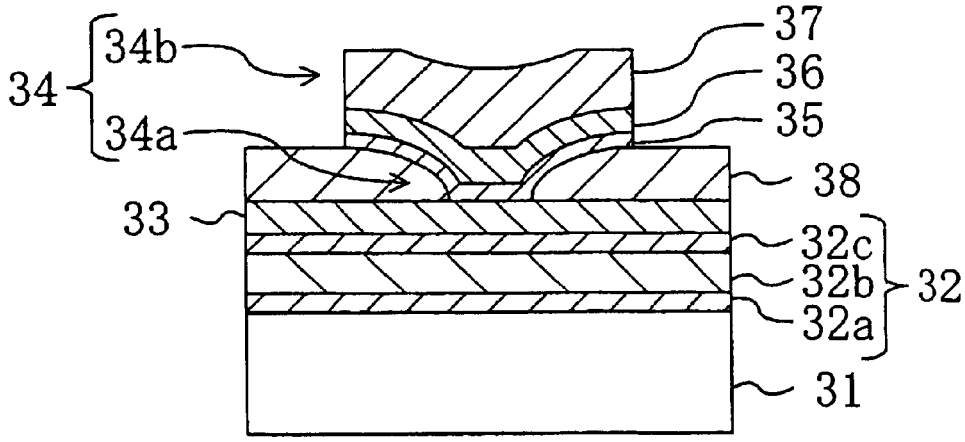

Next, as shown in FIG. 6B, the third resist film 43 shown in FIG. 6A is removed and an unwanted portion of the Au layer in the upper part of the multilayer structure of the second-layer forming layer 36A is removed by using an etchant composed of KI. Subsequently, an unwanted portion of the Ti layer in the lower part of the multilayer structure of the second-layer forming layer 36A shown in FIG. 6A is removed by using hydrogen fluoride, whereby the second-layer forming layer 36A is patterned into the second layer 36 of the linear conductor layer 34.

By the foregoing fabrication steps, there is obtained the microstrip line in an inverted trapezoidal cross-sectional configuration having curved hypotenuses. Depending on the thickness of the support insulating film 38, it is also possible to provide generally straight hypotenuses instead of the curved hypotenuses.

If STO is used in the dielectric layer 33 formed between the linear conductor layer 34 and the ground electrode 32 in the microstrip line as in the second embodiment, the wavelength of an electromagnetic wave propagating along the microstrip line becomes about a quarter of that of an electromagnetic wave propagating along a microstrip line using GaAs as a dielectric material. This indicates that, if STO is used in the dielectric layer 33, the quarter wavelength ($\lambda/4$) of an electromagnetic wave which is 6 mm at a frequency of 5 GHz when GaAs is used in the dielectric layer 33 is reduced to the order of 1.5 mm. The wavelength reducing effect allows the adoption of a distributed constant circuit at 5 GHz, which has been impossible due to a chip size limit, thereby achieving a significant reduction in chip size.

However, the formation of a STO film with a larger thickness is not realistic, as described above. Although a reduction in the width of the conductive material is essential to implementing a microstrip line with higher impedance, a mere reduction in width incurs a higher loss in the microstrip line.

The second embodiment forms the part of the linear conductor layer 34 which adjoins the dielectric layer 33 into the narrower portion 34*a* and defines the impedance of the line by the narrower portion 34*a*, while forming the part of the linear conductor layer 34 at a distance from the dielectric layer 33 into the wider portion 34*b* and thereby restricting a loss by the wider portion 34*b*. This implements a high-impedance and low-loss line.

Although silicon dioxide has been used in the support insulating film 38 which determines the configuration of the narrower portion 34*a* of the linear conductor layer 34, it is preferred not to fill such an insulating material into the space between the dielectric layer 33 and the narrower portion 34*a*. To prevent the insulating material composed of the silicon dioxide from being filled, the insulating material may be removed appropriately with hydrogen fluoride. In the case of filling the insulating material, a low dielectric film having a dielectric constant lower than that of the silicon dioxide composed of an organic material, such as BCB, Duroid•, or a polyimide film, is used preferably. In this case, an organic material is deposited properly by CVD or like method.

Preferably, a larger distance is provided between the dielectric layer 33 and the wider portion 34*b*. The arrangement suppresses the coupling capacitance between the wider portion 34*b* and the ground electrode 32. If the coupling capacitance is increased, the wider portion 34*b* greatly affects the impedance of the strip line and prevents the strip line from having higher impedance.

The microstrip line according to the second embodiment may also be used appropriately to form an inductor element such as a spiral inductor element. The arrangement increases a relative coefficient determined by the ratio of the width of the linear conductor layer 34 to the distance between the linear conductor layer 34 and the ground electrode 32 so that the inductance value of the spiral inductor element is increased.

Because the relative coefficient is also applied to an inductor element having a configuration other than a spiral, the microstrip line according to the present invention is also effective not only in the spiral inductor element but also in inductor elements having other configurations such as a meander, a loop, and the like.

Although the second embodiment has used Au as the primary material of the linear conductor layer 34 and the ground electrode 32, the use of a material having a conductivity higher than that of Au, such as Ag or Cu, further reduces a conductor loss. Alternatively, a superconducting material may also be used as the primary material of the linear conductor layer 34 and the ground electrode 32.

Although the second embodiment has configured the microstrip line as a thin-film microstrip line using STO in the dielectric layer 33 thereof, a thin-film microstrip line using a thin film composed of an organic material or another dielectric material in the dielectric layer 33 is also effective.

Although the second embodiment has used GaAs in the substrate 31, an inorganic material composed of a glass material such as Si or quartz or of alumina or an organic material composed of polystyrene or TEFLON may also be used instead.

It is also possible to use the linear conductor layer 34 having the cross section according to the present embodiment as a signal line of a coplanar line.

Wherein, explained here is the case that the narrower portion 34*a* and the wider portion 34*b* shown in FIG. 4 are integrated into the conductor layer 34. However, the same effects as in this case may be obtained in such a manner that the narrower portion 34*a* and the wider portion 34*b* are respectively made of independent conductive materials through an insulator and the conductive materials are electrically connected with each other through at least one part. The same effects can be obtained in the case of the narrower portion 14*a* and the wider portion 14*b* in FIG. 1.

In FIG. 4, when the substrate 31 has a ground potential, the substrate 31 serves as the ground electrode 32, which results in no electrode 32 required. The same can be said in the case of the ground electrode 12 in FIG. 1.

Embodiment 3

A third embodiment of the present invention will be described with reference to FIGS. 7, 8, 9, 10A–10D, 11A–11D, 12A–12D, 13A–13C, and 14A–14C.

Figure 7:
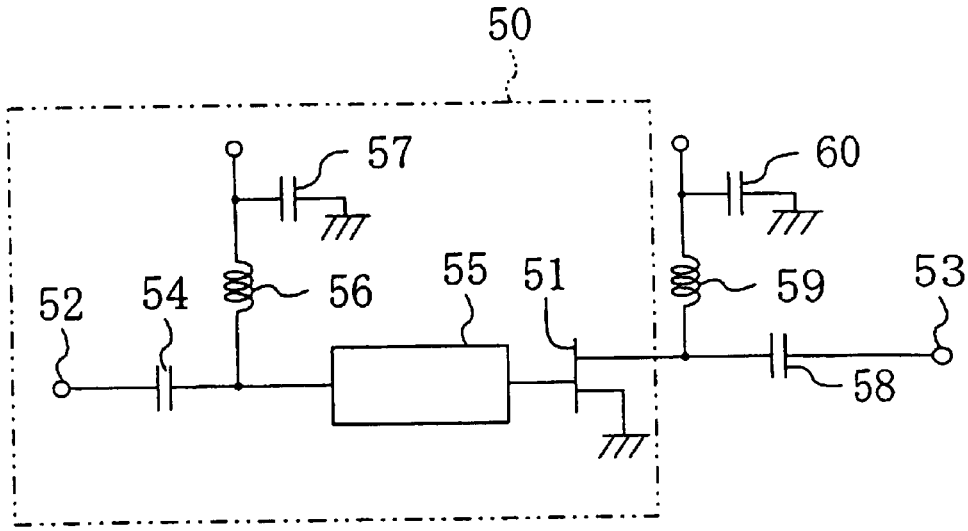
FIG. 7 is a circuit diagram of an RF semiconductor device according to a third embodiment of the present invention.

FIG. 7 shows a circuit structure in an RF semiconductor device according to the third embodiment. As shown in FIG. 7, an input matching circuit is connected to the input side of a FET 51 which is an RF amplifying element and an output matching circuit is connected to the output side thereof.

The input matching circuit is composed of: a dc blocking first capacitor element 54 connected in series between an RF input terminal 52 and the gate of the FET 51; a λ/4 wavelength line (microstrip line) 55; a first inductor element 56 which is an RF choke for bias supply; and a second capacitor element 57 for short-circuiting the RF component of the first inductor element 56.

The output matching circuit is composed of: a dc blocking third capacitor element 58 connected in series between the drain of the FET 51 and an RF output terminal 53; a second inductor element 59 connected in parallel to the drain; and a fourth capacitor element 60 for short-circuiting the RF component of the second inductor element 59. The second inductor element 59 and the fourth capacitor element 60 are provided also to supply a bias signal. In the arrangement, each of the input/output impedances of the FET 51 is converted to about 50Ω.

Figure 8:
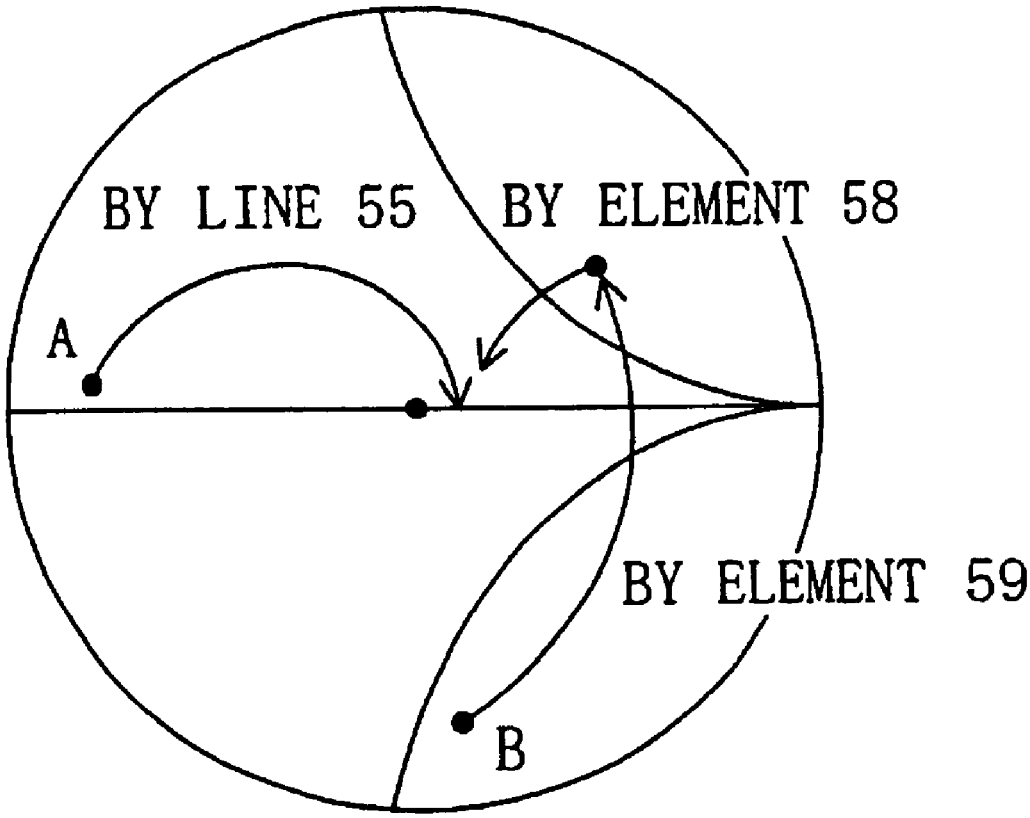
FIG. 8 is a Smith chart for illustrating input/output impedance matching in the RF semiconductor device according to the third embodiment.

FIG. 8 is a Smith chart showing the conversion of the input/output impedances of the FET 51. As shown in FIG. 8, it is assumed that the input impedance of the FET 51 is located at the point A on the chart and the output impedance thereof is located at the point B. The input impedance is converted to about 50Ω by λ/4 wavelength line 55, while the output impedance is converted to about 50Ω by the second inductor element 59 and the third capacitor element 58.

Figure 9:
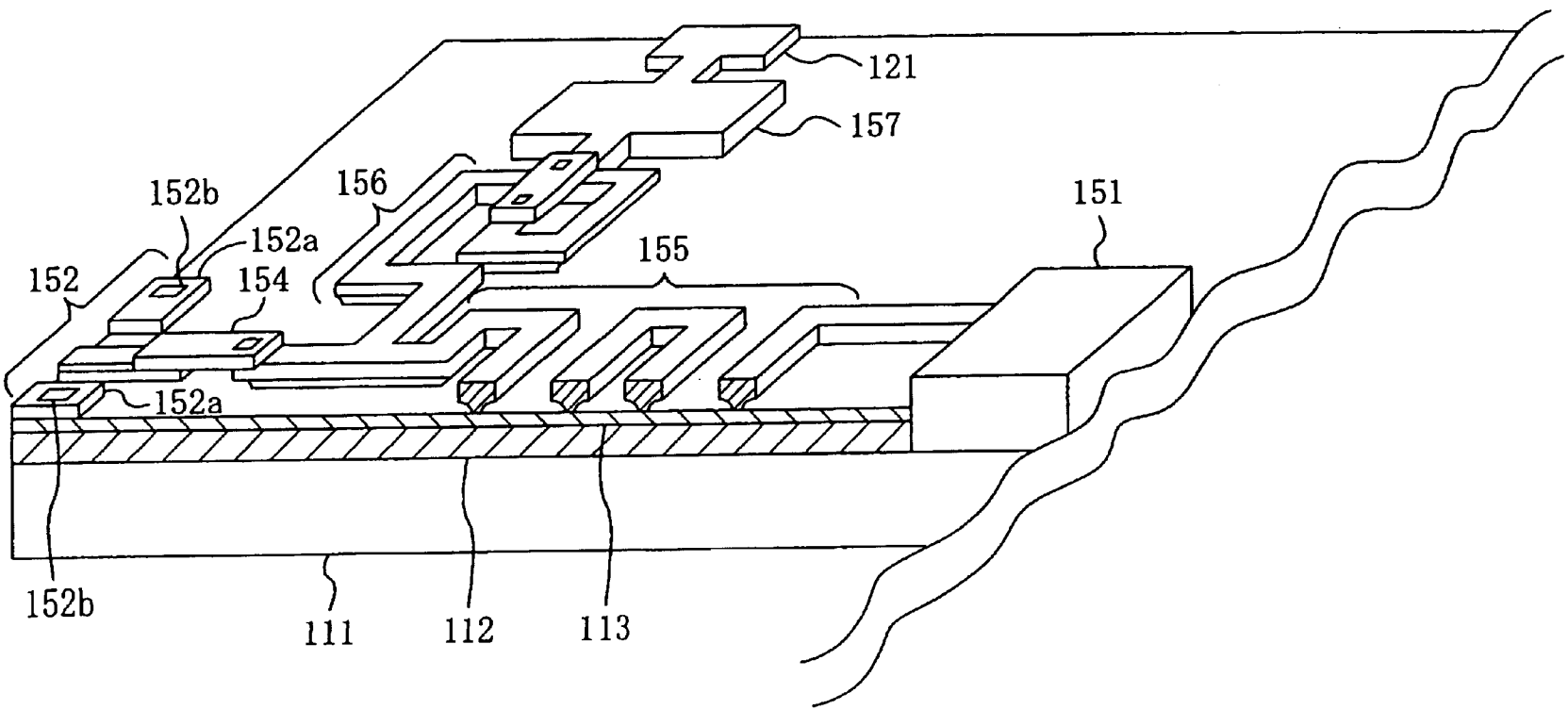
FIG. 9 is a partial perspective view showing the vicinity of an input matching circuit in the RF semiconductor device according to the third embodiment.

FIG. 9 is a partial perspective view of the RF semiconductor device shown in FIG. 7. It is assumed here that the microstrip line shown in the first embodiment is applied by way of example only to the input side. Accordingly, only the region 50 shown in FIG. 7, i.e., only the components including the input matching circuit and the FET 51 are shown.

As shown in FIG. 9, in the RF device according to the third embodiment, a ground electrode 112 and a dielectric layer 113 composed of a STO with a thickness of about 0.5 μm are formed successively on a semi-insulating substrate 111 composed of GaAs to compose the substrate of the microstrip line portion. It is to be noted that the ground electrode 112 has the same structure as shown in FIG. 1. That is, the ground electrode 112 consists of: a first layer composed of a multilayer structure of Ti with a thickness of about 0.05 μm and Au with a thickness of about 0.5 μm; a second layer composed of Au with a thickness of about 2.5 μm; and a third layer composed of a multilayer structure of Pt with a thickness of about 0.2 μm and Ti with a thickness of about 0.02 μm, which are stacked in this order on the substrate 111. For the sake of simplifying the drawings, a FET 151 is represented as a rectangular parallelepiped.

The input side of the FET 151 is connected to one end of a meander-shaped microstrip line 155 which corresponds to the λ/4 wavelength line 55 shown in FIG. 7.

The other end of the microstrip line 155 is connected to one electrode of a first MIM capacitor 154 corresponding to the first capacitor element 54 shown in FIG. 7 and using STO in a capacitor insulating film. The other electrode of the first MIM capacitor 154 is connected to an RF input terminal 152 corresponding to the RF input terminal 52 shown in FIG. 7.

The RF input terminal 152 has a ground-signal-ground (G-S-G) configuration which allows the RF characteristics of the RF device according to the present embodiment to be evaluated by using a probe for RF evaluation and has a ground terminal 152*a* connected to the ground electrode 112 through a via 152*b*.

A connecting portion between the microstrip line 155 and the first MIM capacitor 154 is connected to one end of a spiral inductor 156 corresponding to the first inductor element 56 shown in FIG. 7. The other end of the spiral inductor 156 is connected to one electrode of a second MIM capacitor 157 corresponding to the second capacitor element 57 shown in FIG. 7 and using STO in a capacitor insulating film. The other electrode of the second MIM capacitor 157 is connected to a pad 121 for DC supply.

Referring to the drawings, a description will be given to a method for fabricating the RF semiconductor device thus constituted.

FIGS. 10A to 10D, 11A to 11D, 12A to 12D, 13A to 13C and 14A to 14C show the cross-sectional structures of the RF semiconductor device according to the third embodiment in the individual process steps. For the sake of simplicity, the description will be given to a method for forming, over the substrate 211, a region different from the region 50 shown in FIG. 7 and including a PET formation region 1 in which a FET as an amplifying element is to be formed and a line formation region 2 in which a microstrip line is to be formed, as shown in FIG. 10A.

Figure 10A:
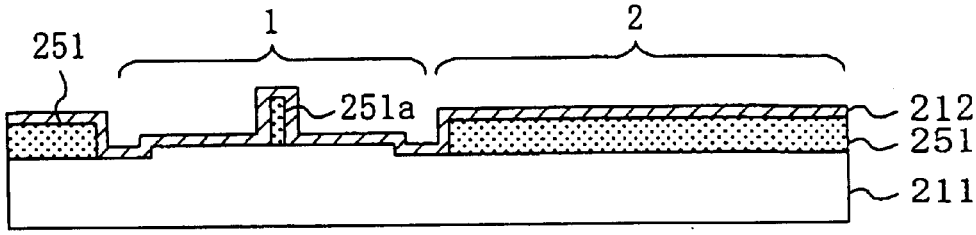
FIGS. 10A, 10B, 10C and 10D are structural cross-sectional views illustrating the individual process steps of a method for fabricating a microstrip line according to the third embodiment.

First, as shown in FIG. 10A, there is prepared a substrate obtained by forming an epitaxial layer including a heterojunction active layer (channel layer) for a FET on the semi-insulating substrate 211 composed of GaAs. The epitaxial layer is composed of, e.g., a buffer layer composed of AlGaAs or InGaAs, a graded buffer layer in which the composition gradually varies from AlAs to InAlAs with a distance from the substrate 211, a channel layer composed of InGaAs, a barrier layer composed of InAlAs having an energy gap larger than that of the channel layer and forming a two-dimensional electron gas layer at an interface with the channel layer, and a contact layer composed of InGaAs, which are stacked in this order on the substrate 211.

Next, mesa etching is performed with respect to the FET formation region 1. Subsequently, a first resist film 251 is coated on the substrate 211 and formed into a line pattern 251*a* with a width of about 0.2 $\mu$m, which is for determining the gate length of the FET, in the FET formation region 1 by lithography using a phase shifting method. Thereafter, a first protective insulating film 212 composed of $SiO_2$ with a thickness of about 0.2 $\mu$m is deposited over the entire surface of the substrate 211 by ion beam sputtering using the first resist film 251 as a mask.

Figure 10B:
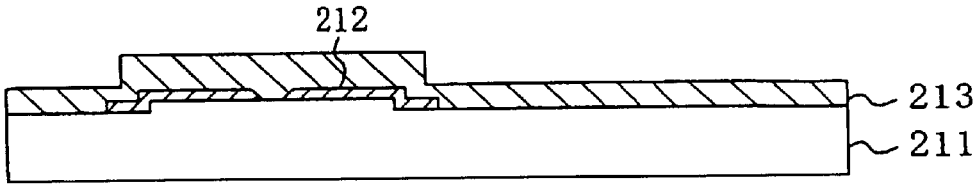

Next, as shown in FIG. 10B, the first resist film 251 shown in FIG. 10A is lifted off and then a second protective insulating film 213 composed of SiN with a thickness of about 0.3 $\mu$m is formed by CVD entirely over the substrate 211 including the first protective insulating film 212.

Figure 10C:
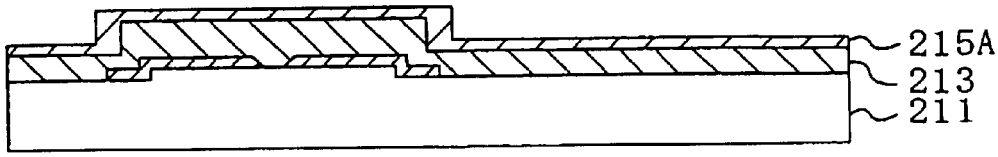

Next, as shown in FIG. 10C, a layer 215A forming the first layer of the ground electrode and composed of a multilayer structure of Ti with a thickness of about 0.05 $\mu$m and Au with a thickness of about 0.5 $\mu$m is formed over the entire surface of the second protective insulating film 213 by vapor deposition.

Figure 10D:
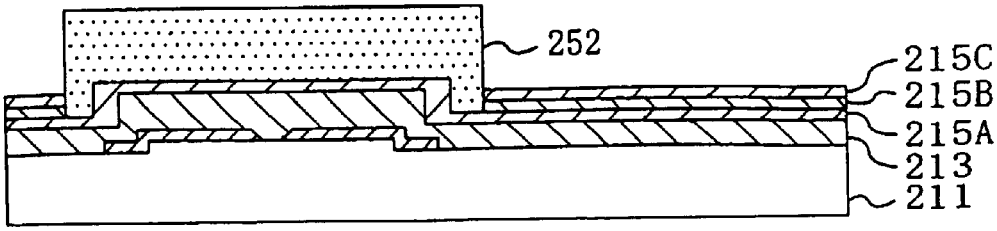

Next, as shown in FIG. 10D, a second resist film 252 covering the FET formation region 1 shown in FIG. 10A is formed. Then, a layer 215B forming the second layer of the ground electrode and composed of Au with a thickness of about 2.5 $\mu$m is formed by plating. Subsequently, a layer 215C forming the third layer of the ground electrode and composed of a multilayer structure of Pt with a thickness of about 0.2 $\mu$m and Ti with a thickness of about 0.02 $\mu$m is formed by vapor deposition again.

Figure 11A:
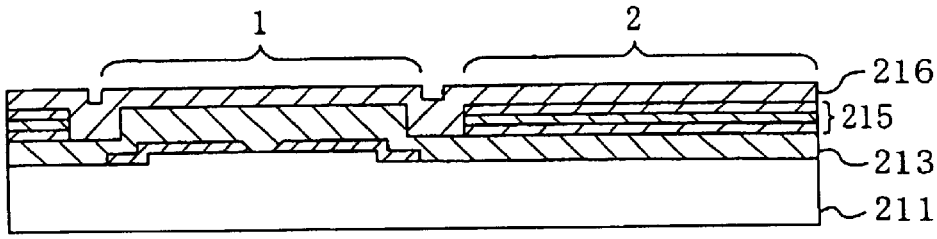
FIGS. 11A, 11B, 11C and 11D are structural cross-sectional views illustrating the individual process steps of a method for fabricating the microstrip line according to the third embodiment.

Next, as shown in FIG. 11A, the second resist mask 252 is removed and the layer 215A forming the first layer in the PET formation region 1 is removed therefrom by using a KI etchant and hydrogen fluoride, whereby a ground electrode 215 composed of the first-layer forming layer 215A, the second-layer forming layer 215B, and the third-layer forming layer 215C is formed in the line formation region 2. Subsequently, a third protective insulating film 216 composed of SiN with a thickness of about 0.3 $\mu$m is deposited over the entire surface of the substrate 211.

Figure 11B:
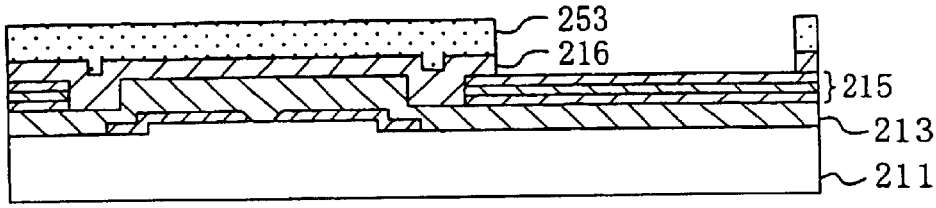

Next, as shown in FIG. 11B, a third resist mask 253 having an opening pattern in the line formation region 2 is formed on the third protective insulating film 216 by lithography. Subsequently, Reactive Ion Etching (RIE) etching is performed with respect to the third protective insulating film 216 by using the third resist film 253 as a mask, thereby exposing the ground electrode 215.

Figure 11C:
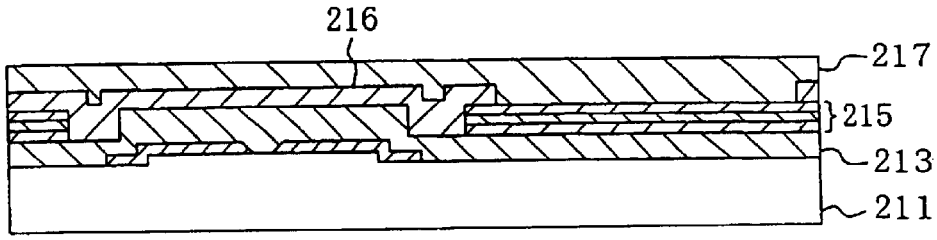

Next, as shown in FIG. 11*c*, the third resist film 253 shown in FIG. 11A is removed and then a dielectric layer 217 composed of STO with a thickness of about 0.5 $\mu$m is deposited entirely over the substrate 211 including the line formation region 2 by RF sputtering for which the substrate temperature is adjusted to about 300° C.

Figure 11D:
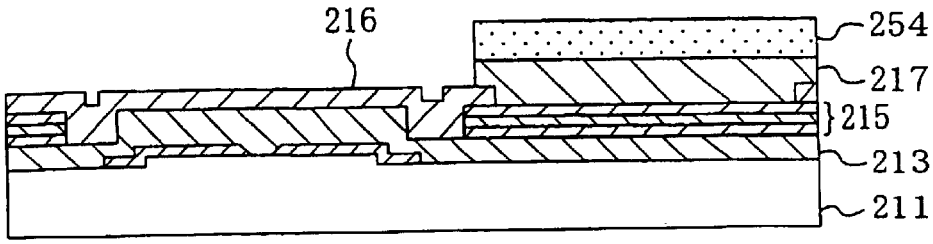

Next, as shown in FIG. 11D, the portion of the dielectric layer 217 included in the FET formation region 1 shown in FIG. 11A is removed by a milling method using a fourth resist mask 254 covering the line formation region 2 of the dielectric layer 217.

Figure 12A:
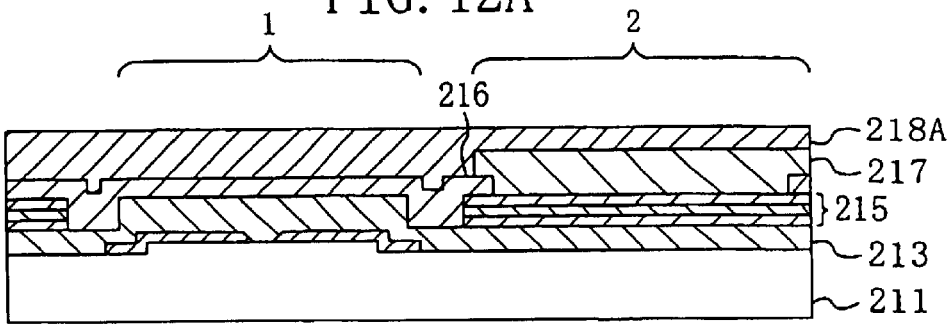
FIGS. 12A, 12B, 12C and 12D are structural cross-sectional views illustrating the individual process steps of a method for fabricating the microstrip line according to the third embodiment.

Next, as shown in FIG. 12A, the fourth resist mask 254 shown in FIG. 11D is removed and then a layer 218A forming the first layer of the linear conductor layer and composed of WSiN with a thickness of about 0.1 $\mu$m is deposited over the entire surface of the substrate 211 by RF sputtering. Thereafter, the dielectric layer 217 is recrystallized by performing sintering in an oxygen ambient at a temperature of about 450° C.

Figure 12B:
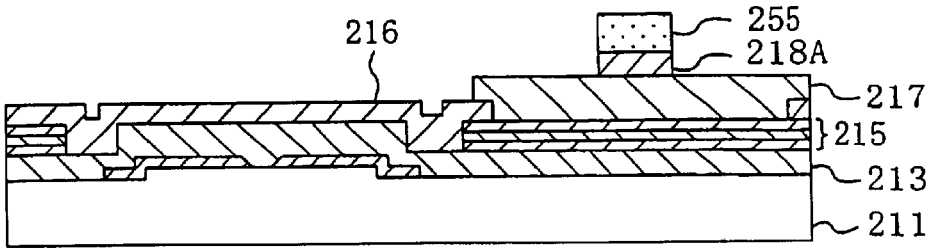

Next, as shown in FIG. 12B, a fifth resist film 255 having a line pattern with a width of about 0.5 $\mu$m for forming the narrower portion of the linear conductor layer is formed on the first-layer forming layer 218A. Subsequently, RIE etching is performed with respect to the first-layer forming layer 218A by using $CF_4$ and $SF_6$ as an etchant and using the fifth resist film 255 as a mask, thereby forming the first layer 218 of the linear conductor layer composed of the first-layer forming layer 218A in the line formation region 2.

Figure 12C:
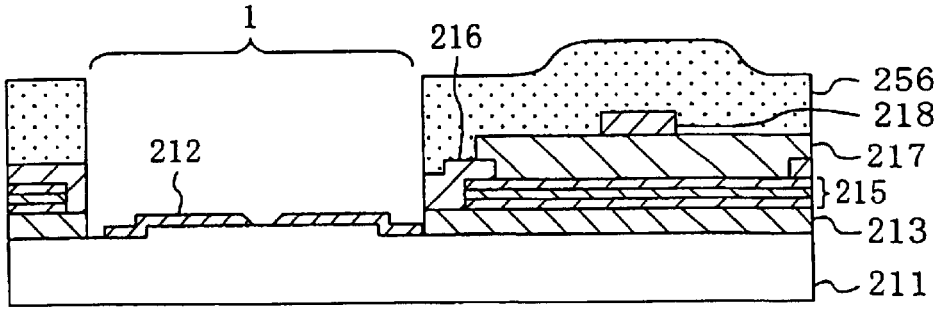

Next, as shown in FIG. 12C, a sixth resist film 256 having an opening pattern for exposing the FET formation region 1 over the substrate 211 is formed on the substrate 211 by lithography. Then, RIE etching is performed with respect to the third and second protective insulating films 216 and 213 by using $CF_4$ as an etchant and using the sixth resist film 256 as a mask, thereby exposing the first protective insulating film 212 through the FET formation region 1 of the sixth resist film 256.

Figure 12D:
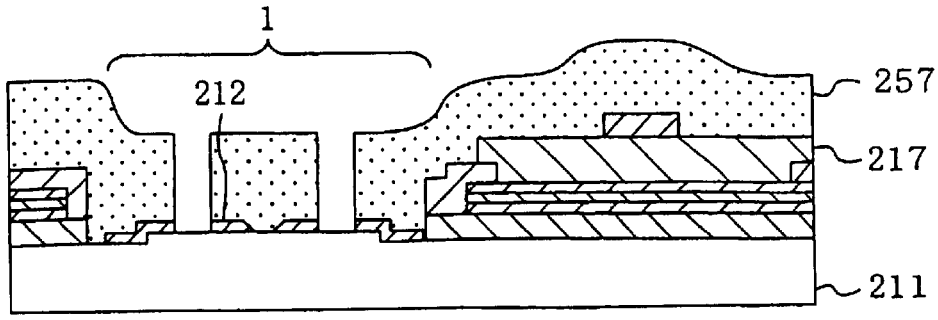

Next, as shown in FIG. 12D, the sixth resist film 256 shown in FIG. 12C is removed and then a seventh resist film 257 having opening patterns for exposing the source/drain formation regions of the FET formation region 1 is formed on the substrate 211 by lithography. Subsequently, etching is performed with respect to the first protective insulating film 212 by using hydrogen fluoride and using the formed seventh resist film 257 as a mask, thereby exposing the source/drain formation regions of the top surface of the substrate 211.

Next, a source/drain-electrode forming film composed of a multilayer structure of AuGe with a thickness of about 50 nm, Ni with a thickness of about 50 nm, and Au with a thickness of about 1000 nm is deposited entirely over the seventh resist film 257 including the opening patterns. Then, the seventh resist film 257 is lifted off, whereby source/drain electrodes 219 are formed from the electrode forming film. Thereafter, a heat treatment is performed by raising the substrate temperature to about 400° C., thereby alloying the source/drain regions 219 and an upper portion of the substrate 211. Then, an eighth resist film 258 having an opening pattern for exposing the gate formation region in the FET formation region 1 is formed on the substrate 211 by lithography. Subsequently, recess etching using a phosphoric acid as an etchant is performed with respect to the upper portion of the substrate 211 by using the formed eighth resist film 258 and the first protective insulating film 212 as a mask, thereby providing the state shown in FIG. 13A.

Figure 13A:
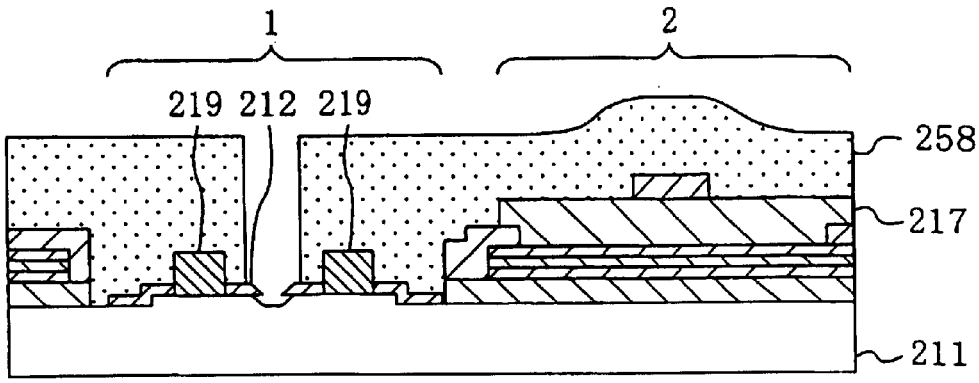
FIGS. 13A, 13B and 13C are structural cross-sectional views illustrating the individual process steps of a method for fabricating the microstrip line according to the third embodiment.
Figure 13B:
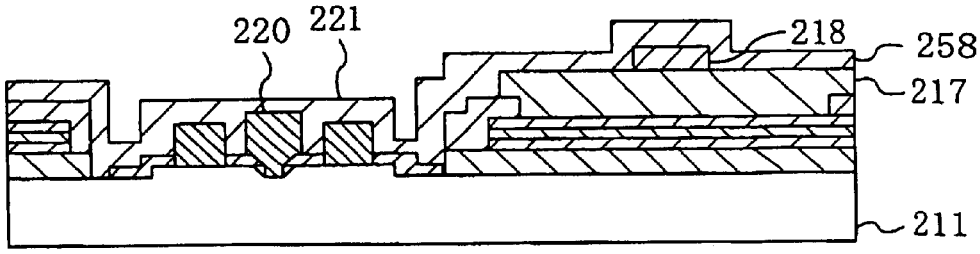

Next, as shown in FIG. 13B, a gate-electrode forming film composed of a multilayer structure of Ti with a thickness of about 500 nm, Al with a thickness of about 5000 nm, and Ti with a thickness of about 500 nm is formed entirely over the eight resist film 258 including the opening pattern by vapor deposition. Then, the eighth resist film 258 is lifted off, whereby a gate electrode 220 is formed from the electrode forming film. Thereafter, a fourth protective insulating film 221 composed of SiN is deposited by CVD over the entire surface of the substrate 211.

Figure 13C:
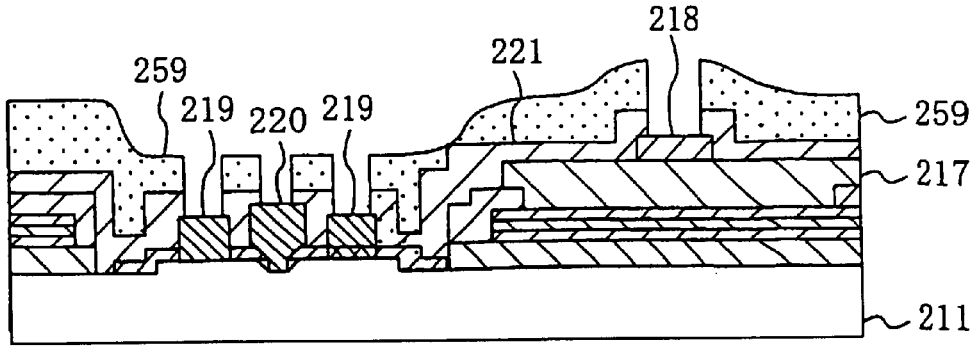

Next, as shown in FIG. 13C, a ninth resist film 259 having opening patterns for exposing the respective portions of the FET formation region 1 located over the source/drain electrodes 219 and over the gate electrode 220 and exposing the portion of the line formation region 2 located over the first layer 218 of the linear conductor layer is formed. Then, RIE etching is performed with respect to the fourth protective insulating film 221 by using $CF_4$ and using the ninth resist film 259 as a mask, thereby exposing each of the electrodes 219 and 220 in the FET formation region 1 and exposing the first layer 218 in the line formation region 2.

Figure 14A:
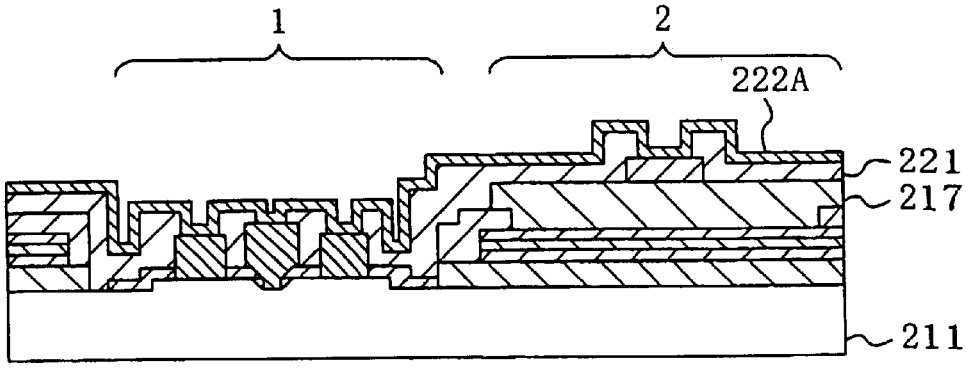
FIGS. 14A, 14B and 14C are structural cross-sectional views illustrating the individual process steps of a method for fabricating the microstrip line according to the third embodiment.

Next, as shown in FIG. 14A, the ninth resist film 259 is removed and then a multilevel layer 222A composed of Ti with a thickness of about 0.05 $\mu$m and Au with a thickness of about 0.15 $\mu$m is formed over the entire surface of the substrate 211 by vapor deposition. The multilevel layer 222A serves as the layer 222A forming the second layer of the linear conductor layer in the line formation region 2.

Figure 14B:
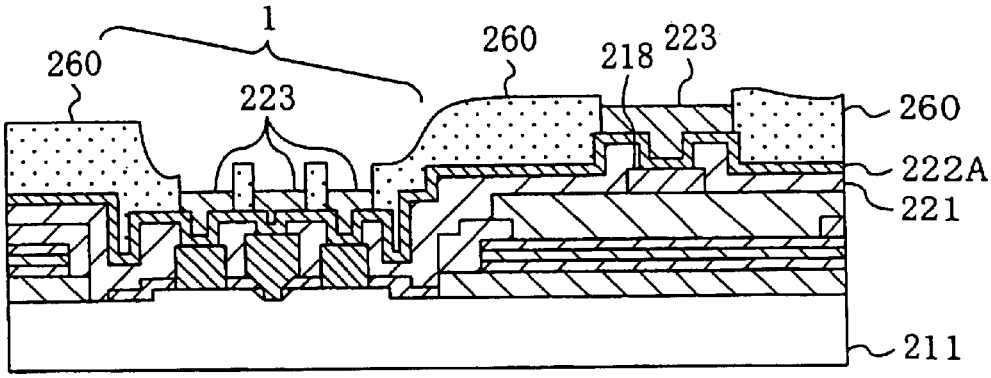

Next, as shown in FIG. 14B, a tenth resist film 260 having opening patterns corresponding to the respective portions of the FET formation region 1 located over the source/drain regions 219 and over the gate electrode 220 and corresponding to an area including the portion of the line formation region 2 located over the first layer 218 of the linear conductor layer is formed by lithography. The opening patterns are connected to the microstrip line in the FET formation region 1, while determining the wider portion of the linear conductor layer having a width of about 5 $\mu$m in the line formation region 2. Subsequently, an Au layer 223 with a thickness of 3 $\mu$m is formed by plating in each of the opening patterns.

Figure 14C:
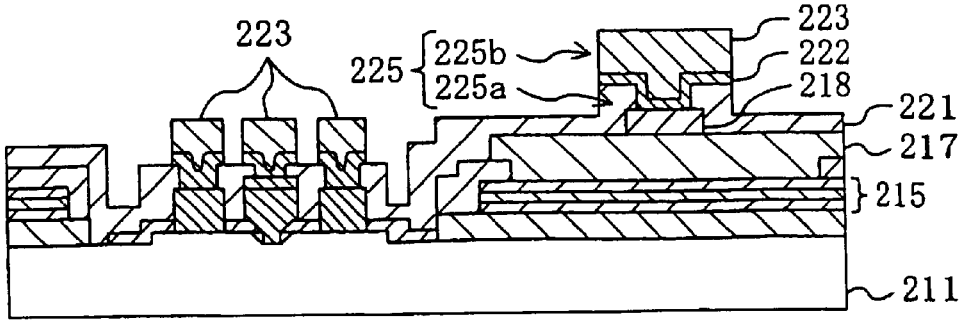
Figure 15:
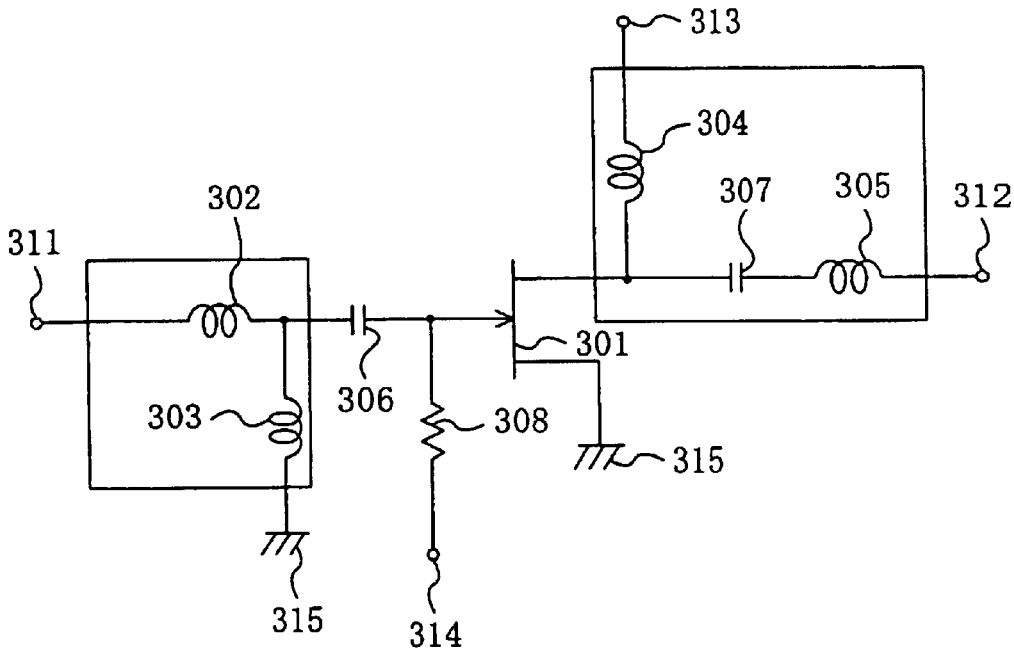
FIG. 15 PRIOR ART
FIG. 15 is a circuit diagram of a conventional RF semiconductor device.
Figure 16:
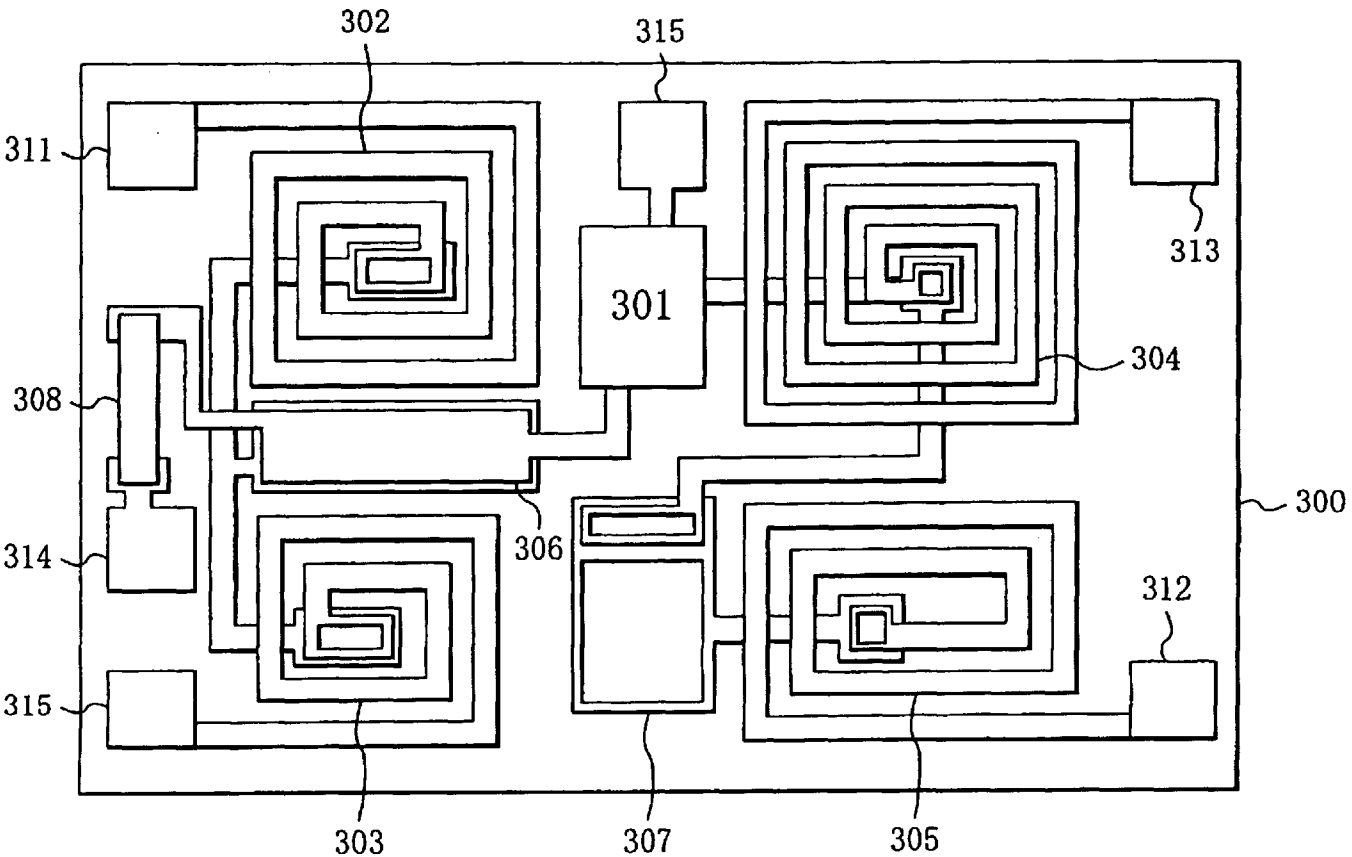
FIG. 16 PRIOR ART
FIG. 16 is a plan view of the conventional RF semiconductor device formed into an MMIC.

Next, as shown in FIG. 14C, the tenth resist film 260 is removed and then an unwanted portion of the Ti/Au multilevel layer 222A is removed by using a KI etchant and hydrogen fluoride, whereby a wider portion 225*b* of the linear conductor layer including the second layer 222 and the Au layer 223 is formed in the line formation region 2. From the wider portion 225*b* and a narrower portion 225*a*, a microstrip line 225 having a T-shaped cross-sectional configuration is formed.

Each of the microstrip line 155 and the spiral inductor 156 may also be composed of a material other than Au, such as Ag or Cu.

Although the third embodiment has used the FET as an example of the active element, the active element may be a diode or a bipolar transistor such as HBT. Although GaAs has been used in the substrate, silicon (Si) may also be used instead.

If an epitaxial layer using GaAs in the substrate and containing the active layer of the FET is structured as mentioned in the third embodiment, there can be adopted the following structure which is advantageous in terms of characteristics. Since the buffer layer composed of AlGaAs or InGaP provided between the substrate and the graded buffer layer presents excellent lattice matching with GaAs, the film thickness thereof can be increased relatively. This prevents fluorine atoms which are contained in the substrate during the formation thereof and undesired because of their possibility to cause a kink from being diffused from the substrate or buffer layer side toward the graded buffer layer side and to the channel layer side.

It is also possible to form the microstrip line according to the present embodiment on a substrate made of glass or quartz on which an active element cannot be formed and mount, by flip-chip bonding, an active element prepared separately on the substrate formed with the microstrip line.

Although the space between the wider portion 225*b* of the linear conductor layer 225 and the dielectric layer 217 is filled with the fourth protective insulating film 222 composed of SiN in the present embodiment, the space may be filled preferably with a material having a lower dielectric constant such as an inorganic thin film composed of, e.g., $SiO_2$ or with an organic thin film composed of BCB, DUROID, or the like.

Since the perimeter of a cross section of the microstrip line taken in a direction perpendicular to the direction in which the microstrip line extends is increased according to the present embodiment, the conductor loss can significantly be reduced particularly in the frequency regions of micro waves and millimeter waves in which the conductor skin effect is dominant and the perimeter of the line greatly affects the conductor loss.

By using Cu or Ag as a primary material of the microstrip line, the conductor loss can further be reduced.

A description will be given to the effect of using a high dielectric material such as STO as the dielectric material used in the microstrip line. The wavelength of an electromagnetic wave propagating through the dielectric material is proportional to $1/\sqrt{\epsilon}$. Since the dielectric constant of STO is about 200, which is more than ten times the dielectric constant of GaAs which is 12.9, the wavelength of the electromagnetic wave propagating along the microstrip line becomes about a quarter or less of that of an electromagnetic wave propagating along a microstrip line using GaAs. If the microstrip line using STO as a dielectric material according to the present embodiment is used, sufficient integration is achievable by folding the line into a meander configuration since the $\lambda/4$ wavelength becomes 1.6 mm at a frequency of 5 GHz. This allows impedance conversion using an on-chip $\lambda/4$ line as in the present embodiment, which is extremely effective in a matching circuit used for a high-power MMIC.

If the microstrip line of the present embodiment is applied to an MMIC operating in the frequency region of quasi-millimeter wavers, $\lambda/4$ is reduced to about 300 $\mu$m, which allows a significant reduction in the area of a matching circuit using a distributed constant. Since the chip size can thus be reduced in the frequency region of each of micro waves and millimeter waves, there is achieved a remarkable effect of reducing the cost of an MMIC operating in the frequency region of millimeter waves, which is particularly high in cost.

Since a conventional via providing a connection between the linear conductor layer and the ground electrode has a connection length (hole length) of about 40 $\mu$m to 100 $\mu$m, the influence of the impedance thereof cannot be ignored particularly in the frequency region of millimeter waves. However, since a hole length of about 0.5 $\mu$m can be achieved in the microstrip line according to the present embodiment, there can be obtained an ideal short having an electrical length of 0 even in the high frequency region of several hundreds of gigahertz.

What is claimed is:

1. A microstrip line comprising:

a ground conductor layer;

a dielectric layer disposed on the ground conductor layer;

a linear conductor layer disposed on the dielectric layer to have a linear configuration, the linear conductor layer having a wider portion in an upper part of a cross section thereof taken in a direction perpendicular to a direction in which the linear conductor layer extends and a narrower portion in a lower part of the cross section, the narrower portion being smaller in width than the wider portion and a substrate for holding the ground conductor layer, the substrate being located under the ground conductor layer and being composed of a dielectric material, wherein the dielectric layer has a dielectric constant higher than a dielectric constant of the substrate, wherein the dielectric layer contains a titanium oxide.

2. A microstrip line comprising:

a ground conductor layer;

a dielectric layer disposed on the ground conductor layer;

a linear conductor layer disposed on the dielectric layer to have a linear configuration, the linear conductor layer having a wider portion in an upper part of a cross section thereof taken in a direction perpendicular to a direction in which the linear conductor layer extends and a narrower portion in a lower part of the cross section, the narrower portion being smaller in width than the wider portion and a substrate for holding the ground conductor layer, the substrate being located under the ground conductor layer and being composed of a dielectric material, wherein the dielectric layer has a dielectric constant higher than a dielectric constant of the substrate, wherein the dielectric layer contains a titanium oxide, and wherein the titanium oxide is a strontium titanate.

* * * * *